US008293475B2

(12) United States Patent
Okamoto

(10) Patent No.: US 8,293,475 B2
(45) Date of Patent: Oct. 23, 2012

(54) APPARATUS AND METHOD FOR EXAMINING NUCLEIC ACID USING CAPSULE

(75) Inventor: Hideaki Okamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 400 days.

(21) Appl. No.: 12/534,027

(22) Filed: Jul. 31, 2009

(65) Prior Publication Data

US 2010/0028897 A1 Feb. 4, 2010

(30) Foreign Application Priority Data

Aug. 4, 2008 (JP) ..... 2008-201329

(51) Int. Cl.
*C12Q 1/68* (2006.01)
*C12P 19/34* (2006.01)
*C12M 1/00* (2006.01)

(52) U.S. Cl. ..... 435/6.12; 435/91.2; 435/287.2

(58) Field of Classification Search ..... 435/6.12, 435/91.2, 287.2

See application file for complete search history.

(56) References Cited

U.S. PATENT DOCUMENTS

| | | | | |
|---|---|---|---|---|
| 7,041,481 | B2 * | 5/2006 | Anderson et al. | 435/91.2 |
| 2004/0180346 | A1 | 9/2004 | Anderson | |
| 2005/0202429 | A1 | 9/2005 | Trau | |
| 2006/0078888 | A1 | 4/2006 | Griffiths | |
| 2007/0003975 | A1 * | 1/2007 | Imamura et al. | 435/7.1 |
| 2008/0176230 | A1 * | 7/2008 | Owen et al. | 435/6 |

FOREIGN PATENT DOCUMENTS

| | | | |
|---|---|---|---|
| JP | 10-313861 | A | 12/1998 |
| JP | 2002-531056 | A | 9/2002 |
| WO | 2006/038035 | A2 | 4/2006 |
| WO | 2008/005241 | A | 1/2008 |
| WO | 2008/005241 | A2 | 1/2008 |

* cited by examiner

*Primary Examiner* — Kenneth R. Horlick
(74) *Attorney, Agent, or Firm* — Canon U.S.A., Inc., IP Division

(57) ABSTRACT

A biopolymer examining apparatus includes a capsule-forming unit configured to form a capsule by sealing a target biopolymer and a reagent with a capsule film, a transferring unit configured to transfer the capsule, an amplification reaction unit configured to amplify the target biopolymer while having the target biopolymer enclosed in the capsule, and a detecting unit configured to detect the amplified target biopolymer while having the target biopolymer enclosed in the capsule.

23 Claims, 11 Drawing Sheets

APPARATUS AND METHOD FOR EXAMINING NUCLEIC ACID USING CAPSULE

BACKGROUND OF THE INVENTION

1. Field of the Invention

The present invention relates to an apparatus and a method for examining a target biopolymer such as a gene and the like through amplification of the biopolymer using capsules.

2. Description of the Related Art

In amplifying DNA, plastic reactors are usually used to carry out a reaction between target DNA and a particular enzyme. In the case where a well plate or the like is used as the reactor, it not only takes time to dispense samples but also requires a large space for amplification reactions and detection of amplification results, which has been a problem. To resolve this problem, a method is suggested in which target DNA and an amplification reaction sample are enclosed in a capsule and DNA is amplified inside the capsule.

Japanese Patent Laid-Open No. 10-313861 ('861 document) describes conducting DNA amplification reactions inside capsules. According to this patent document, a sample is taken out of a capsule by centrifugal separation, by an aspiration technique using capillary tubes, or the like in order to analyze DNA amplified in the capsule. The taken-out sample is then analyzed by electrophoresis, high-performance liquid chromatography, enzyme immunoassay, or the like to obtain results such as presence and absence of amplification products. In other words, according to this technique, only the amplification reaction is conducted in the capsule, and the crucial step of analyzing the results of amplification reactions is conducted in a reaction tube composed of polypropylene or the like, as has been practiced in the past. This means that, according to the method described in the '861 document, an extra step of transferring the sample from the capsule to the reaction tube composed of polypropylene or the like is needed in comparison to the related art. This complicates the procedure as a whole. Encapsulation of the amplification sample rather requires more work than dispensing of the sample.

Moreover, in order to efficiently analyze large quantities of amplification products, equipment such as well plates is needed. Thus, space-saving attempted by the '861 document remains unachieved when the examination process is viewed as a whole.

Furthermore, when mishandling occurs in the course of taking the encapsulated amplified DNA out of the capsule, the amplified DNA may scatter into atmosphere, land on nearby regions, or stay afloat in the air. Thus, there is a risk that contamination will occur for other DNA analysis.

In systems for examining biopolymers such as genes, large quantities of different specimens must be processed quickly. In order to handle specimens containing different types of DNA and the like within a single system, care must be taken to avoid contamination. In some cases, a plurality of types of reagents and the like to be mixed with specimens are needed depending on the contents of the examination. They need to be handled smoothly and quickly.

Still other techniques for performing amplification by enclosing samples in capsules have been disclosed.

United Stated Patent Laid-Open No. 2005-0202429 discloses a process of conducting polymerase chain reaction (PCR) in a permeable (penetrative) capsule and detecting the amplification products.

International Publication No. WO 06/038035 discloses a technique of performing expression inside microcapsules, transporting the microcapsules in a fluid, and sorting the microcapsules by flow cytometry (FCM) or the like.

However, none of the techniques described in these patent documents is designed to or is compatible to continuously perform a series of processes including encapsulation, amplification, and detection on a plurality of different specimens and reagents.

SUMMARY OF THE INVENTION

The present invention provides an apparatus and a method for examining an amplified biopolymer, by which different specimens can be continuously or simultaneously processed and in which countermeasures against contamination and measures that allow use of a plurality of reagents are sufficiently taken. On the basis of an idea completely different from that conceived in the related art, the present invention provides a biopolymer examining apparatus that addresses the problem of contamination while allowing use of a plurality of specimens and a plurality of reagents. The present invention also provides a method for examining a biopolymer by which contamination can be prevented.

A first aspect of the present invention provides a biopolymer examining apparatus that includes a capsule-forming unit configured to form a capsule by sealing a target biopolymer and a reagent with a capsule film, a transferring unit configured to transfer the capsule, an amplification reaction unit configured to amplify the target biopolymer while having the target biopolymer enclosed in the capsule, and a detecting unit configured to detect the amplified target biopolymer while having the target biopolymer enclosed in the capsule.

A second aspect of the present invention provides a method for examining a biopolymer, the method including steps of forming a capsule by sealing a target biopolymer and a reagent with a capsule film, transferring the capsule, amplifying the target biopolymer while having the target biopolymer enclosed in the capsule, and detecting the amplified target biopolymer while having the target biopolymer enclosed in the capsule.

According to the apparatus and method for examining the biopolymer, a biopolymer, which is an examination subject such as DNA, is enclosed in a capsule, amplified within the capsule, subjected to detection, and finally dicarded. Accordingly, the biopolymer such as DNA and the like can be prevented from being scattered into the atmosphere. Moreover, the biopolymer is prevented from mixing with another biopolymer which is the next examination subject. Thus, contamination can be prevented and stable examination results can be obtained.

Further features of the present invention will become apparent from the following description of exemplary embodiments with reference to the attached drawings.

DESCRIPTION OF THE EMBODIMENTS

The present invention will now be described in detail by using the preferred embodiments for implementing the present invention. Note that the individual embodiments discloses here are merely examples of actual use of the biopolymer examining apparatus and method of the present invention and thus should not be understood as limiting the scope of the present invention.

A biopolymer examining apparatus of the present invention includes a capsule-forming unit configured to seal a target biopolymer and a reagent with a capsule film to form a capsule, a transferring unit configured to transfer the capsule, an amplification reaction unit configured to amplify the target biopolymer while having the target biopolymer enclosed in the capsule, and a detecting unit configured to analyze the amplified target biopolymer while having the target biopolymer enclosed in the capsule.

Here, the phrase, "while having the target biopolymer enclosed in the capsule" means that, after the target biopolymer is sealed in the capsule, the target biopolymer is never taken out of the capsule during the process from the amplification in the amplification reaction unit to the detection in the detecting unit.

First Embodiment

Figure 1:
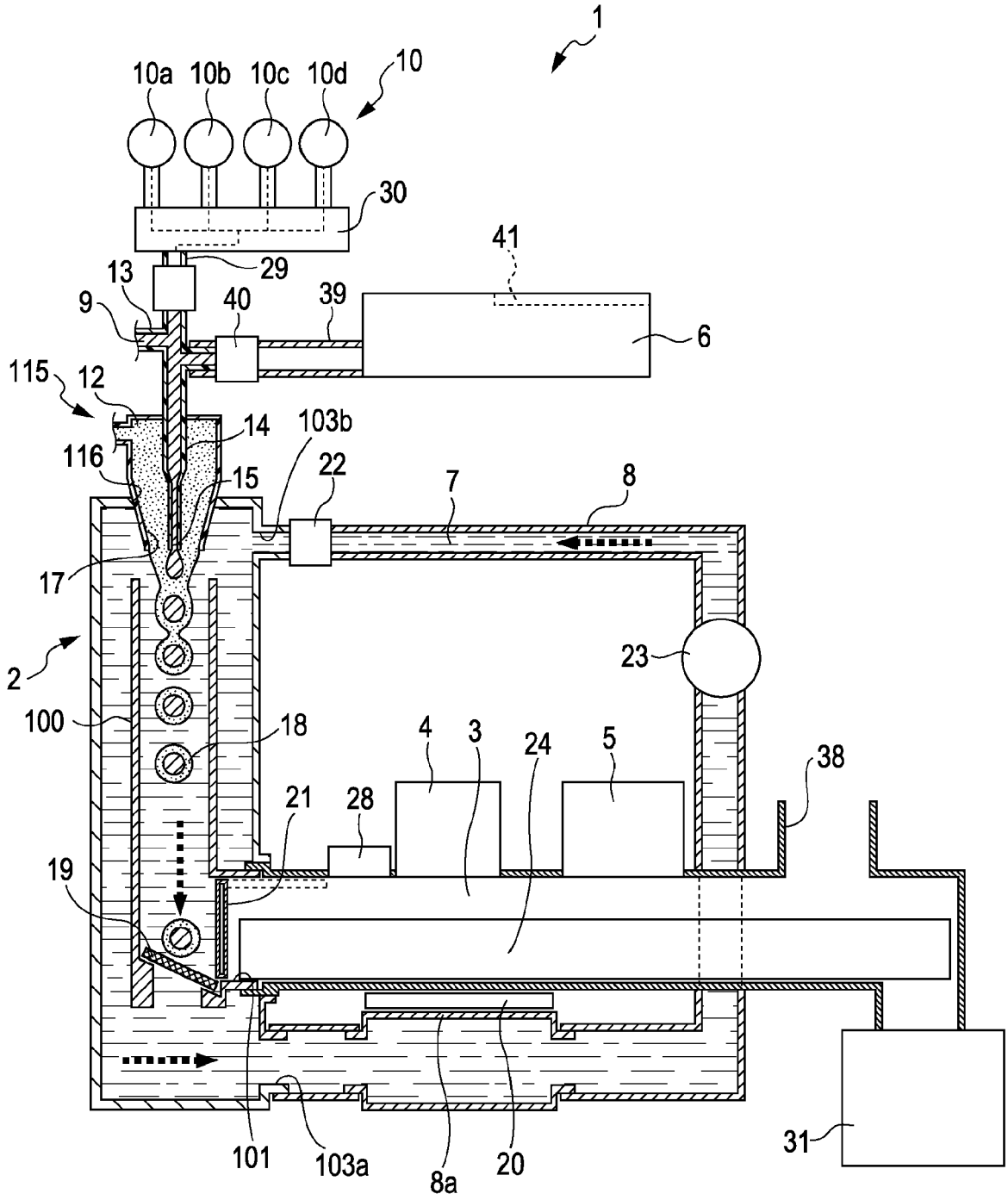
FIG. 1 is a conceptual diagram of a first embodiment of the present invention.

FIG. 1 is a schematic view of a first embodiment of the present invention. The first embodiment will now be described in detail.

Capsule-Forming Unit

In the first embodiment of the present invention, a capsule-forming unit of a biopolymer examining apparatus 1 includes a capsule-forming section 2, a capsule-forming nozzle section 115, and a cooling channel 8. The amplification reaction unit includes a temperature controller 20. The detecting unit at least includes one of an amplification detector 4 detecting amplification of the biopolymer and a melting detection section 5 conducting thermal melting detection. The transferring unit includes a transfer belt 24 and a driven belt 25 (see FIG. 2). The capsule-forming section 2 of the first embodiment of the present invention includes a capsule channel 100, a nozzle connecting port 116, and coolant channel connecting ports 103*a* and 103*b*.

As shown in FIG. 1, a sealed circulation channel is constructed with the capsule-forming section 2 and the cooling channel 8 sealed at coolant channel connecting ports 103*a* and 103*b* so as to supply a coolant 7 necessary for forming capsules. The coolant 7 flows counterclockwise in the sealed circulation channel constituted by the capsule-forming section 2 and the cooling channel 8. A control valve 22 for controlling the coolant 7 can be installed between the capsule-forming section 2 and the cooling channel 8 and at the coolant channel connecting port 103*b* downstream of the circulation channel. PA pump 23 for causing the coolant 7 to circulate may be provided between the coolant channel connecting port 103*a* and the control valve 22.

Basically, the coolant 7 is circulated and reused. However, the amount of the coolant 7 gradually decreases by prolonged continuous use since the coolant 7 that has adhered on the surfaces of capsules formed is removed. The coolant 7 is stored in a main tank (not shown) in the apparatus and the remaining quantity is constantly monitored. When the remaining quantity decreases to a first predetermined level or less, the user is urged to add or replace the coolant. When the remaining quantity decreases to a second predetermined level or less, the use is alarmed and the operation of the apparatus is stopped. A sub tank (not shown) for temporarily storing the coolant 7 in the capsule-forming section 2 and a control valve (not shown) between the capsule-forming section 2 and the sub tank can be provided.

The capsule channel 100 includes a receiver 19, a gate 21 serving as a coolant blocking member, and a transferring unit connecting port 101. The receiver 19 receives a capsule 18 descending in the coolant 7. The receiver 19 can thus be composed of a material that does not damage the capsule 18. The receiver 19 can be formed of a mesh. The gate 21 serving as the coolant blocking member remains closed until the receiver 19 receives the capsule 18 to hold the coolant 7 in the capsule channel 100. The gate 21 can be composed of a heat resistant material such as a metal. The coolant blocking member of the present invention can at least be disposed upstream of a discarding unit described below.

The capsule-forming nozzle section 115 includes a first nozzle 15 and a second nozzle 17. The first nozzle 15 is connected to a common channel 14 into which a reagent channel 29 and a specimen channel 13 for supplying a specimen 9, i.e., a biopolymer, are merged. The reagent channel 29 is connected to a reagent switcher 30 having four branched channels respectively connected to reagent reservoirs 10*a*, 10*b*, 10*c*, and 10*d*. The types of the reagents to be introduced can be selected by operating the reagent switcher 30. A specimen introducing section (not shown) is disposed upstream of the specimen channel 13. The second nozzle 17 is arranged to have the same central axis as the first nozzle 15. The second nozzle 17 discharges a film solution 12 that forms the films of capsules.

In this invention, in order to prevent a biopolymer such as DNA or the like from adhering onto inner walls of the channels and the like during introduction or capsule formation, at least the inner walls (inner surfaces) of all channels of the capsule-forming nozzle section 115 can be treated to prevent adhesion of the specimen 9. In particular, the inner surface of the common channel 14 can be subjected to an adhesion preventive treatment. To be more specific, the inner surfaces can be negatively charged. This is because the biopolymer, e.g., DNA, contained in the specimen is negatively charged. DNA and the like are prevented from remaining in the channel by utilizing the principle of repulsion between the negatively charged biopolymer and the negatively charged channel inner walls.

An example of the method for negatively charging the first nozzle 15 is a method of forming the nozzle with polytetrafluoroethylene (PTFE) and allowing the nozzle to contact with a metal. Alternatively, the nozzle may be constructed by PTFE negatively charged in advance. The second nozzle 17 can also be charged by the above-described method. The inner walls of the capsule-forming section 2 of the present invention can also be negatively charged.

A capsule film is composed of a polysaccharide (in particular, curdlan and/or agarose) or a protein which has high compatibility with biological body and light-transmitting property. The capsules 18 can be provided as uniform capsules by accurately controlling the size and interior content of the capsules during production. The capsules 18 of the present invention feature high heat resistance and high physical strength.

The capsule film contains a polysaccharide or a protein as a main component. Examples of the polysaccharide used in the present invention include curdlan, agarose, gellan gum, pectin, and sodium alginate. Examples of the proteins include those having property to form a gel by heating, cooling, or addition of a divalent or higher-valent metal salt, e.g., gelatin, albumin, and casein. The polysaccharide and protein are not limited to those described above. The polysaccharide and protein have high compatibility with biological body high light-transmitting property and are thus suitable for forming films of the capsules 18 of the present invention. Among the components that form the capsule films, the polysaccharide and protein may respectively be used alone or as a mixture of two or more types, or in combination with other additives such as a gelling agent, a water-soluble polyhydric alcohol, or a water-soluble derivative thereof. The gelling agent refers to a compound containing a divalent or higher-valent metal ion. Examples thereof include calcium chloride, calcium lactate, manganese chloride, and aluminum chloride. Examples of the water-soluble polyhydric alcohol or water-soluble derivative thereof include glycerin, polyglycerin, sorbit, ethylene glycol, polyethylene glycol, propylene glycol, polypropylene glycol, an ethylene oxide-propylene oxide copolymer, an oligosaccharide, a sugar ester, glyceride, and a sorbitan ester.

Examples of the target biopolymer include template nucleic acids that serve as templates in PCR amplification reactions. Examples of the template nucleic acids include DNA extracted from organisms, messenger RNA, and synthetic DNA or RNA. DNA extracted from organisms generally contains base components such as adenine, cytosine, guanine, and thymine. RNA extracted from organisms contains adenine, cytosine, guanine, and uracil. A synthetic nucleic acid may contain bases other than those described above as long as they are recognizable by polymerases.

A primer is a single strand DNA fragment (naturally or non-naturally occurring oligonucleotide) composed of some ten to several tens of bases. The primer is an essential element for amplifying DNA by a polymerase chain reaction (PCR) technique and is needed to define the reactive site for starting synthesis with a DNA polymerase. The reactive site for starting the synthesis can be arbitrary selected. The primer can be any compound that is recognizable by DNA polymerases contained together in the capsule and can be used in the reaction. The primer has a complementary base sequence to the template nucleic acid.

The substrates used in the first embodiment of the present invention are essential for synthesizing DNA by PCR in the capsule 18. In the case of DNA amplification, such substrates are four types of mononucleotides constituted by respective base components (four base components such as adenine, cytosine, guanine, and thymine) and a sugar (2-deoxy-D-ribose), i.e., deoxyadenosine 5'-triphosphate, deoxycytidine 5'-triphosphate, deoxyguanosine 5'-triphosphate, and deoxythymidine 5'-triphosphate (in general, these four types of mononucleotide are collectively referred to as "dNTPs"). In addition to these substrates, deoxyinosine 5'-triphosphate or the like may also be contained.

The substrates required for synthesizing RNA can be four types of mononucleotides composed of respective base components (adenine, cytosine, guanine, and uracil) and a sugar (ribose).

A DNA polymerase is needed to amplify DNA fragments from the template DNA by PCR in the capsule 18. In order to synthesize cDNA from the template RNA in the capsule 18, either a reverse transcriptase must be contained in addition to the DNA polymerase or a DNA polymerase that has an activity of a reverse transcriptase must be contained. In such a case, cDNA is first synthesized by heating for a predetermined length of time at a temperature at which the reverse transcriptase is active and then PCR is conducted if amplification is needed.

Desired RNA can be synthesized by transcribing DNA or cDNA synthesized as such by incorporating an RNA polymerase in the capsule 18. In other words, the capsule 18 of the first embodiment can contain one or more types of polymerases needed to synthesize desired nucleic acids.

In the first embodiment, the desirable amounts of biopolymer synthetic materials to be contained in one capsule are 1 to $10^{10}$ strands of template nucleic acids, 10 to 100 pmol of primer, 0.1 to 0.4 mM of substrates, and 0.1 to 0.4 U of polymerases per total of 100 μL of the biopolymer synthetic materials. With respect to the unit "U" for the polymerase, 1 U is the amount of oxygen needed to incorporate 10 nmol dNTPs into acid-insoluble precipitates in 30 minutes while using M13mp18ssDNA and its primer as the substrates under 75° C. activity measurement conditions.

Transferring Unit

According to the present invention, the biopolymer after amplification is measured without being contaminated. In order to do so, the capsule formed must be transferred to the amplification reaction unit without breaking and the capsule containing the amplified biopolymer must be transferred to the analysis unit without breaking the capsules. Thus, the transferring unit of the first embodiment of the present invention is connected to the transferring unit connecting port 101 of the capsule channel 100 in the capsule-forming section 2 so that the capsule formed in the capsule-forming section 2 can be immediately transferred to the amplification reaction unit and the detecting unit.

In this invention, any transferring unit that can transfer the sealed biopolymer without leakage or damaging the film of the capsule 18 can be employed. For example, contact- and non-contact-type transfer methods are available. If a contact-type transfer method is employed, the capsule can be transferred to a desired position by bringing a transfer belt, a robot hand, a tweezers-like devise, or the like into contact with the capsule.

As for the non-contact-type transfer method, a capsule can be transferred to a desired position by using a liquid flow of a coolant or the like, air pressure, or a guiding member, such as a magnet, that applies a magnetic force from outside a capsule containing magnetic particles. Alternatively, a capsule can be transferred to a desired position by allowing the capsule to fall by its own weight (such as by designing a vertical channel or an oblique channel or by tilting the channel only during the transfer). In this embodiment, the transfer belt 24 shown in FIG. 2 is used.

Figure 2:
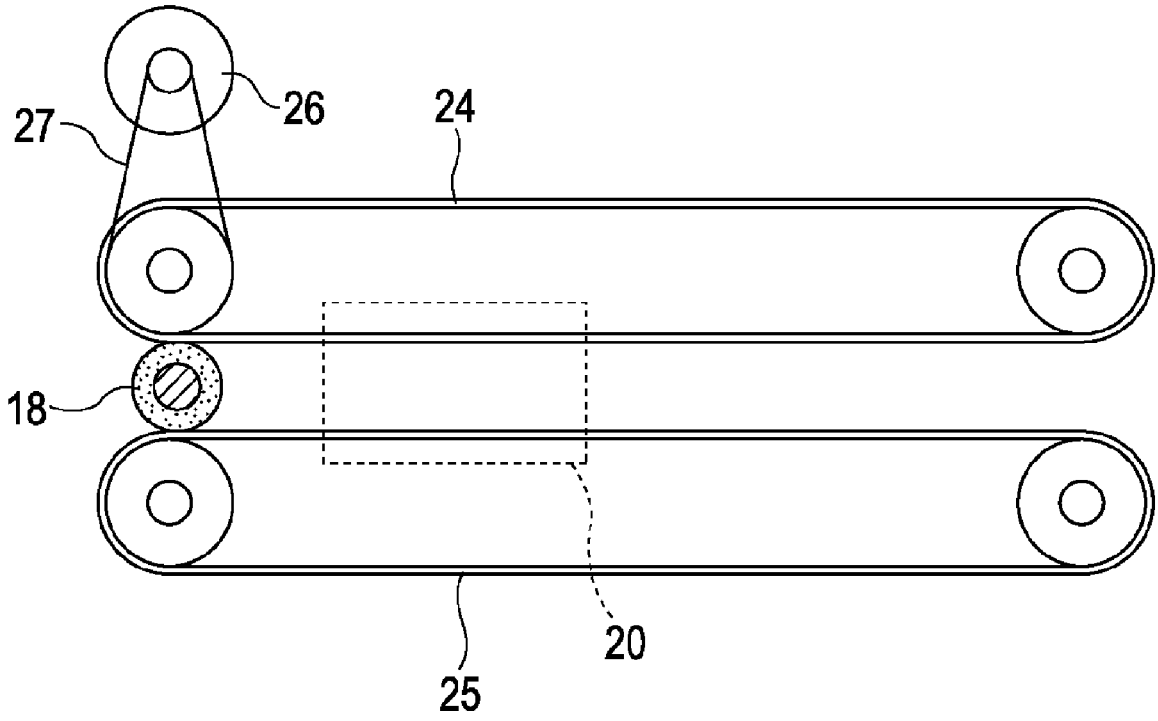
FIG. 2 is a conceptual diagram of a transferring unit of the first embodiment.

In this invention, the transfer belt 24 and the driven belt 25 shown in FIG. 2 can be used. FIG. 2 is a plan view of the structure of the transfer belt 24 and the driven belt 25. The transfer belts 24 and the driven belt 25 are paired and oppose each other at the inner side of the cooling channel 8. The output from a motor 26 is transmitted to the transfer belt 24 via a drive transmission belt 27. The driven belt 25 is driven via a drive transmission mechanism (not shown) from the pulley of the transfer belt 24. The spacing between the transfer belt 24 and the driven belt 25 is slightly smaller than the outer diameter of the capsule 18 so that the capsule 18 can be held between and transferred.

In this invention, the formed capsules 18 reach the receiver 19 inclined toward the gate 21 as shown in FIG. 1, pass through the open gate 21, and roll in the direction toward the transfer belt 24 and the driven belt 25 by their own weights. A vibrating unit can be additionally provided near the receiver 19 so that the capsules 18 can roll without adhering onto the receiver 19.

In this invention, a discarding unit can be formed downstream of the transfer belt 24. In the first embodiment, a discarding section 31, which is a specific example of the discarding unit, is disposed downstream of the transfer belt 24 (downstream of the coolant blocking member). The capsule 18 that has passed through the detecting unit is transferred to the discarding section 31 by the transfer belt 24 and stored in the discarding section 31. When the number of capsules 18 reaches a predetermined value, the discarding section 31 is closed with a lid and replaced with an empty discarding section 31. An optical sensor is installed at the inlet of the discarding section 31 to count the capsules 18 entering the discarding section 31. The lid is closed by an automatic lid driving mechanism (not shown) once the number reaches a predetermined value. The lid has a protruding part that fits the recessed part of the discarding section 31. The amount of fit is designed so that the protruding part of the lid does not easily come off from the recessed part.

In addition to or instead of providing the protruding and recessed parts to form the fit, the lid and the discarding section 31 may be partly integrated by bonding or fusion-bonding to prevent analyzed capsules 18 from overflowing from the discarding section 31.

Amplification Reaction Unit

The amplification reaction unit of the first embodiment of the present invention includes an amplification reaction section 3. The amplification reaction section 3 is provided to amplify the biopolymer within the capsule. Since the temperature must be controlled for amplification reaction of the biopolymer, in this embodiment, a peltier device is provided as the temperature controller 20 to control the temperature. The coolant adhering onto the capsule 18 may be evaporated by heating with the peltier device of the amplification reaction section 3.

In this embodiment, a droplet removing section 28 for removing the coolant adhering onto the capsule 18 can be installed upstream of the amplification reaction section. The droplet removing section 28 can be constituted by a blower, a vibrator, or the like. There is no need to send air until the coolant 7 is completely removed from the surface of the capsule 18. The coolant 7 should be removed to a degree at which the transfer and the subsequent detection step are not adversely affected. Instead of the blower, the vibrator, or the like, a heater, e.g., a peltier device of the temperature controller 20, may be used to evaporate the coolant 7.

In some cases, such as in the case of PCR, temperature changes must be controlled depending on the amplification method employed. In such cases, as shown in FIG. 1, the capsules 18 can be put under the temperature change environment required for PCR by controlling the temperature of the peltier device by making a coolant pipe 8*a* to contact or not to contact the lower surface of the peltier device of the temperature controller 20. When the gate 21 is closed, the coolant 7 is prevented from entering the detecting unit. Thus, the coolant 7 can be circulated even when formation of capsules is not taking place.

Examples of the techniques of the amplification reaction include the PCR technique that requires temperature changes and other techniques that do not require temperature changes, such as a loop-mediated isothermal amplification (LAMP) technique. In the case where the LAMP technique is employed to conduct the amplification reaction, the temperature of the amplification reaction unit can be maintained at a constant level by adjusting the peltier element of the temperature controller 20 or the coolant 7.

Detecting Unit

The detecting unit of the first embodiment of the present invention at least includes the amplification detector 4 for detecting amplification of the biopolymer and the melting detection section 5 that performs thermal melting detection. In the first embodiment, the detecting unit can be disposed above the transferring unit so that the amplified biopolymer in the capsules is immediately transferred to the detecting unit by the transferring unit and the results of the amplification can be analyzed immediately after completion of the amplification. In particular, the amplification detector 4 and the melting detection section 5 can be disposed above the transfer belt 24 and the driven belt 25 (FIG. 2) serving as the transferring unit shown in FIG. 1, and at the midstream and downstream positions in the transfer direction, respectively.

According to this arrangement, the capsule 18 containing the biopolymer amplified in the amplification reaction unit is transferred by the transfer belt 24 to the detecting unit constituted by the amplification detector 4 and the melting detection section 5, and the biopolymer in the capsule 18 immediately after amplification can be detected.

As shown in FIG. 1, the amplification detector 4 may be disposed vertically above the peltier device, i.e., the temperature controller 20, with the transfer belt 24 between the peltier device and the amplification detector 4 to detect the amplified biopolymer in real time. In other words, the amplification detector 4, the capsule 18, the transfer belt 24, and the peltier device serving as the temperature controller 20 can align in that order from the top to the bottom. According to this arrangement, changes in the biopolymer during the ongoing amplification reaction can be detected.

The amplification detector 4 can be an optical system that includes an excitation light irradiation section and a fluorescence detecting section. The amplified biopolymer in the capsule 18 is labeled with a fluorescent labeling substance and thus can be detected with the amplification detector 4 constituted by the optical system. In this invention, an intercalator that emits fluorescence by irradiation with the excitation light when bonded with double strand DNA can be used. For example, SYBR Green I can be used.

The fluorescence detection of the present invention is not limited to the intercalator technique. For example, the fluorescence may be monitored by a TaqMan probe technique. This technique uses probes modified with a fluorescent material and a quencher and detects the fluorescence emitted when the activity of the quencher is lost during propagation.

In the present invention, the amplification detector 4 and the amplification reaction section 3 (temperature controller 20) can be arranged one above another with the transfer belt 24 therebetween. When excitation light is applied to the capsule 18 while performing amplification reaction by PCR cycles in the amplification reaction unit, the fluorescence emitted from inside the capsule 18 changes according to the number of double strands formed in the capsule 18. Thus, the intensity of fluorescence is measured with the amplification detector 4 to calculate the amount of double strand DNA formed, on the basis of the intensity of the fluorescence.

The detecting unit of the present invention can include the melting detection section 5 in addition to the amplification detector 4. The melting detection section 5 can be disposed downstream of the amplification detector 4. In particular, as shown in FIG. 1, after the amplified biopolymer is detected with the amplification detector 4, it is transferred to the melting detection section 5 by the transfer belt 24. In the melting detection section 5, the fluorescence is detected while heating the capsule 18. The transition profile of the changes in fluorescence intensity versus changes in temperature, i.e., the waveform of the fluoresce intensity and the temperature, is differentiated and the singular point (Tm) of the temperature change is specified to determine the type of DNA, i.e., the target biopolymer.

The method for examining a biopolymer according to the present invention includes a step of forming a capsule by sealing a target biopolymer and a reagent with a capsule film, a step of transferring the capsule, a step of carrying out amplification reaction while having the target biopolymer enclosed in the capsule, and a step of detecting the amplified target biopolymer while having the target biopolymer enclosed in the capsule. The step of forming the capsule by sealing the target biopolymer and the reagent with a capsule film will now be described. The step of forming the capsule is conducted in the capsule-forming nozzle section 115. As shown in FIG. 1, a reagent suitable for amplification of the specimen 9, i.e., a target biopolymer, is determined from among the reagent reservoirs 10. A reagent to be encapsulated determined as such is then selected from the four branched channels of the reagent switcher 30. The selected reagent passes through the specimen channel 13 and flows into the common channel 14 by using a pressuring unit (not shown). After a designated amount of the reagent is allowed to flow, the reagent switcher 30 is driven so that the reagent switcher 30 is not communicated with any of the four channels.

A biopolymer, e.g., a DNA solution, extracted from blood or urine by an extracting unit (not shown) is injected to a DNA tester from a specimen introducing section (not shown). The DNA solution passes through the specimen channel 13 by the pressuring unit (not shown), flows toward the capsule-forming section 2, and merges with the reagent in the common channel 14 to form a mixture. Meanwhile, the film solution 12 is supplied to the second nozzle 17 outside the first nozzle 15 by a pressuring unit (not shown). The film solution 12 supplied to the second nozzle 17 flows toward the tip of the second nozzle 17, and the mixture of the reagent and the specimen 9 is sealed in the center portion of the capsule 18 at the tip of the second nozzle 17 as shown in FIG. 1.

The reagent used here may be any reagent composed of an enzyme for amplifying the target biopolymer, e.g., DNA, dNTP, a fluorescent labeler, a primer, and the like. The reagent may be liquid or may be contained in a capsule. The main component of the film solution 12 may be any component that can seal the biopolymer and the reagent and withstand temperature during amplification but does not obstruct detection by the detecting unit. In this invention, the main component can be gelatin, agar, or the like. The reagent used in the present invention may be liquid or encapsulated. In this embodiment, an encapsulated reagent is stored in the examination apparatus in advance and supplied to the capsule-forming section 2 so that the encapsulated reagent can be enclosed in the capsule 18.

The coolant 7 is supplied from the main tank (not shown) into the sealed circulation channel, constituted by the capsule-forming section 2 and the cooling channel 8, by opening the control valve 22, and fills the circulation channel. The reagent and the specimen 9 wrapped and sealed in the film solution 12 are introduced dropwise from the tip of the second nozzle 17. As a result, a layered capsule shown in FIG. 1 is formed. The layered capsule descends as it is cooled by the surrounding coolant 7 and an independent capsule 18 is formed by separating with a vibrating unit (not shown) disposed at the second nozzle 17. The capsule 18 keeps descending and stops at the receiver 19 having a mesh structure.

Until the capsule 18 is formed, the coolant 7 circulates by flowing through the cooling channel 8 via the receiver 19 and returning to the tip of the second nozzle 17. Once the capsule is formed and reaches the receiver 19, the control valve 22 is closed. As a result, the coolant 7 filling the capsule-forming section 2 having the capsule channel 100 returns to the sub tank (not shown) via the cooling channel 8. After all the coolant 7 is removed from the capsule-forming section 2, the gate 21 is opened.

Next, a step of transferring the capsule 18 is performed. As shown in FIG. 1, since the receiver 19 is sloped toward the gate 21 serving as the coolant blocking member, the capsule 18 rolls toward the transfer belt 24 and the driven belt 25 (FIG. 2) by its own weight once the gate 21 is opened. A vibrating unit may be disposed near the receiver 19 so that the capsule 18 can roll without adhering to the receiver 19. The capsules 18 pass through the gate 21 and reach the droplet removing section 28. At this stage, the surface of the capsule 18 is still wet with the coolant 7. The coolant 7 is removed by sending wind from a blower (not shown) in the droplet removing section 28. The dried capsule 18 is transferred to the amplification reaction section 3 where amplification reaction is carried out. When the capsule 18 is transferred to a particular position, its presence is detected with an optical sensor (not shown). Driving of the motor 26 (FIG. 2) is stopped and the transfer belt 24 is stopped. As a result, the capsule 18 comes above the peltier device, i.e., the temperature controller 20. The peltier device is controlled to a predetermined temperature to conduct a PCR temperature cycle to amplify a biopolymer, e.g., DNA, inside the capsule 18.

The step of detecting the amplified target biopolymer can include detection of amplification by the amplification detector 4 and the melting detection of the target biopolymer by the melting detection section 5. In order to detect the amplification reaction by the amplification detector 4 in real time, the amplification detector 4 may be installed on the amplification reaction section 3 and disposed above the peltier device serving as the temperature controller 20. When the capsule 18 is irradiated with excitation light while performing the PCR cycle, the fluorescence emitted from inside the capsule 18 changes depending on the number of double strands formed. The intensity of fluorescence is measured by the amplification detector 4, and the amount of double strand DNA formed can be determined on the basis of the intensity of the fluorescence.

After a predetermined number of PCR cycles are finished, the transfer belt 24 is driven and the capsules 18 are transferred to the melting detection section 5. In the melting detection section 5, the fluorescence is detected while heating the capsules 18. As described above, the waveforms of the intensity of the fluorescence and temperature are differentiated and the singularity point (Tm) of the temperature change is specified to determine the type of the target DNA in the capsule 18. Lastly, the capsule 18 detected in the melting detection section 5 is transferred to the discarding section 31 by the transfer belt 24. In the first embodiment, the capsule 18 is automatically transferred to the amplification reaction unit and the detecting unit and then finally to the discarding section 31 by the transfer belt 24. In other words, after the detecting step, a step of discarding the capsule 18 is provided. A plurality of specimens can be easily and continuously processed in a compact fashion by sequentially performing a forming step, a transferring step, an amplification reaction step, and a detecting step within a channel disposed in the apparatus.

The process from forming one capsule 18 to discarding the capsule 18 after detection according to the first embodiment has been described up to here by describing a step of forming a capsule by sealing a target biopolymer and a reagent in a capsule, a step of transferring the capsule, a step of amplifying the target biopolymer, and a step of detecting the amplified target biopolymer.

However, the present invention is not limited to processing of one capsule. A plurality of capsules can be simultaneously or sequentially formed and subjected to amplification and detection. In particular, after the step of forming a capsule, a step of forming a second capsule containing a target biopolymer and a reagent at least one of which is changed from those of the capsule described above may be further provided. For example, after a certain time has elapsed, the reagent switcher 30 is switched and connected to a second reagent to be encapsulated next so that the specimen is merged with the second reagent. During this process, the first reagent and the specimen are encapsulated and then a second capsule 18 is formed. Third and fourth capsules 18 are formed in the same manner. Thus, the capsule-forming unit can form a plurality of desired independent capsules.

To be more specific, after the first capsule 18 is formed, the control valve 22 is closed to hold the coolant 7, and, at the same time, discharging from the nozzles is stopped. After the coolant 7 is removed from the regions near the receiver 19, the pump 23 is stopped and the gate 21 is opened to transfer the capsule 18 rightward by using the transfer belt 24 and the driven belt 25. Before forming the second capsule 18, the gate 21 is closed. The control valve 22 is opened and the coolant pump 23 is driven to fill the capsule channel 100 with the coolant 7. Discharging from the first nozzle 15 and the second nozzle 17 is then resumed. The second capsule 18 is formed as with the first capsule 18 and then transferred rightward. Similarly, a third capsule and fourth capsule 18 are automatically formed and detected by using the biopolymer examination apparatus of the present invention.

Second Embodiment

In a second embodiment of the present invention, a process of continuously (simultaneously) examining four capsules is described. The second embodiment differs from the first embodiment only in the transferring unit that transfers the capsules, and other components, structures, and the like are identical. In particular, the difference between the biopolymer examination apparatus of the first embodiment and the biopolymer examination apparatus of the second embodiment lies in the receiver 19.

Figure 3:
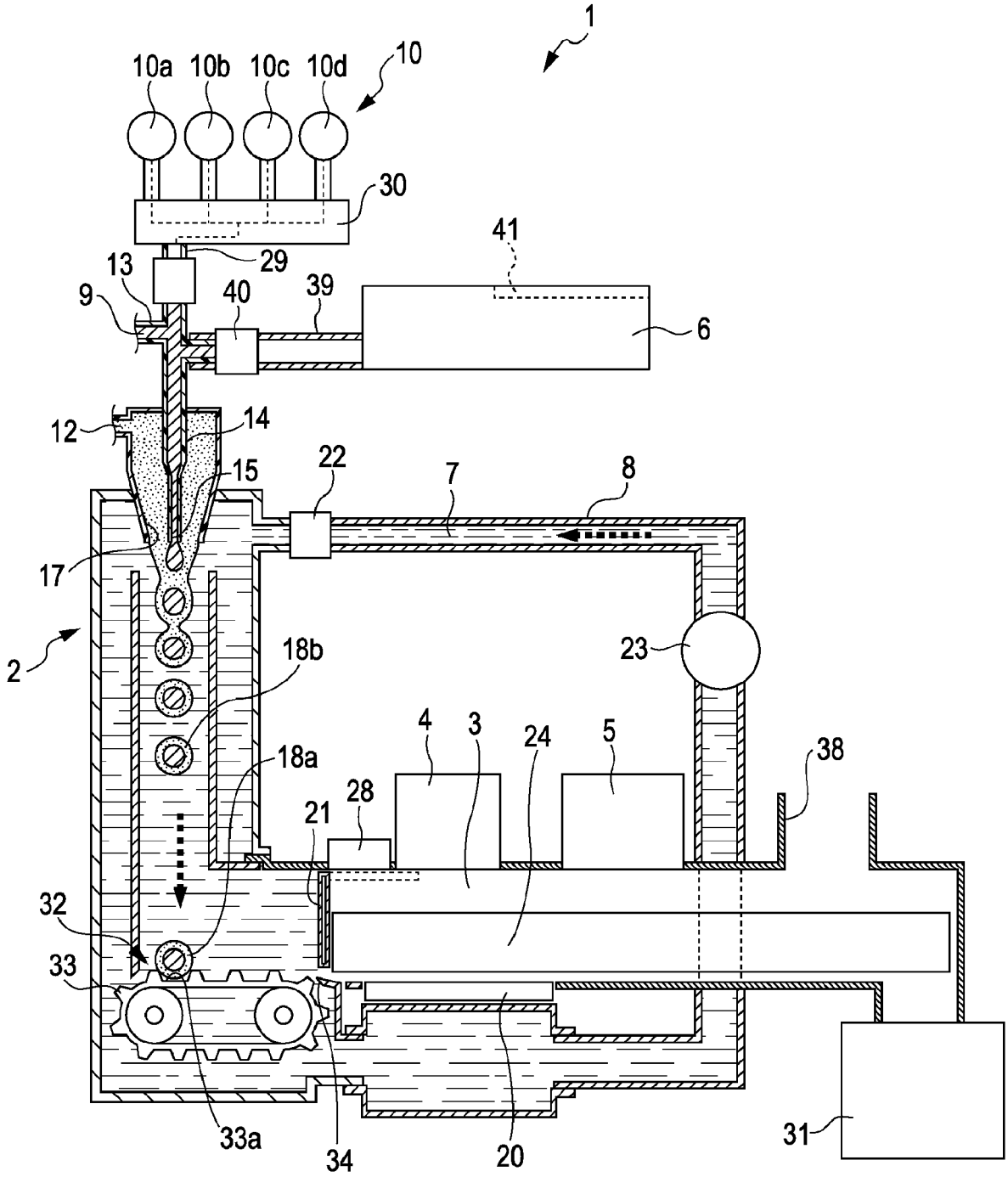
FIG. 3 is a conceptual diagram of a second embodiment of the present invention.

FIG. 3 is a schematic view of the second embodiment of the present invention. In the second embodiment, capsules 18*a* and 18*b* are received by a receiver 32 constituted by a bumpy transfer belt 33 having bumps in the surface. The bumpy transfer belt 33 is rotated with a driving unit (not shown). The rotating rate is variably controlled according to the speed of forming the capsules 18*a* and 18*b*.

The second embodiment differs from the first embodiment in the step of forming capsules by sealing a target biopolymer and a reagent and a step of transferring the capsules. Other steps of the second embodiment are the same as in the first embodiment.

The step of forming capsules by sealing a target biopolymer and a reagent in each capsule is carried out as follows. Intermittent vibrations are applied to the second nozzle 17 to discharge independent spherical capsules 18 continuously from the nozzle. As a result, independent capsules can be continuously formed.

The step of transferring the capsules is carried out as follows. A spherical first capsule 18*a* falls, reaches the receiver 32, and lands on a recess 33*a*. The bumpy transfer belt 33 is rotated so that a second capsule 18*b* can land on the same position as the first capsule 18*a*.

Figure 4:
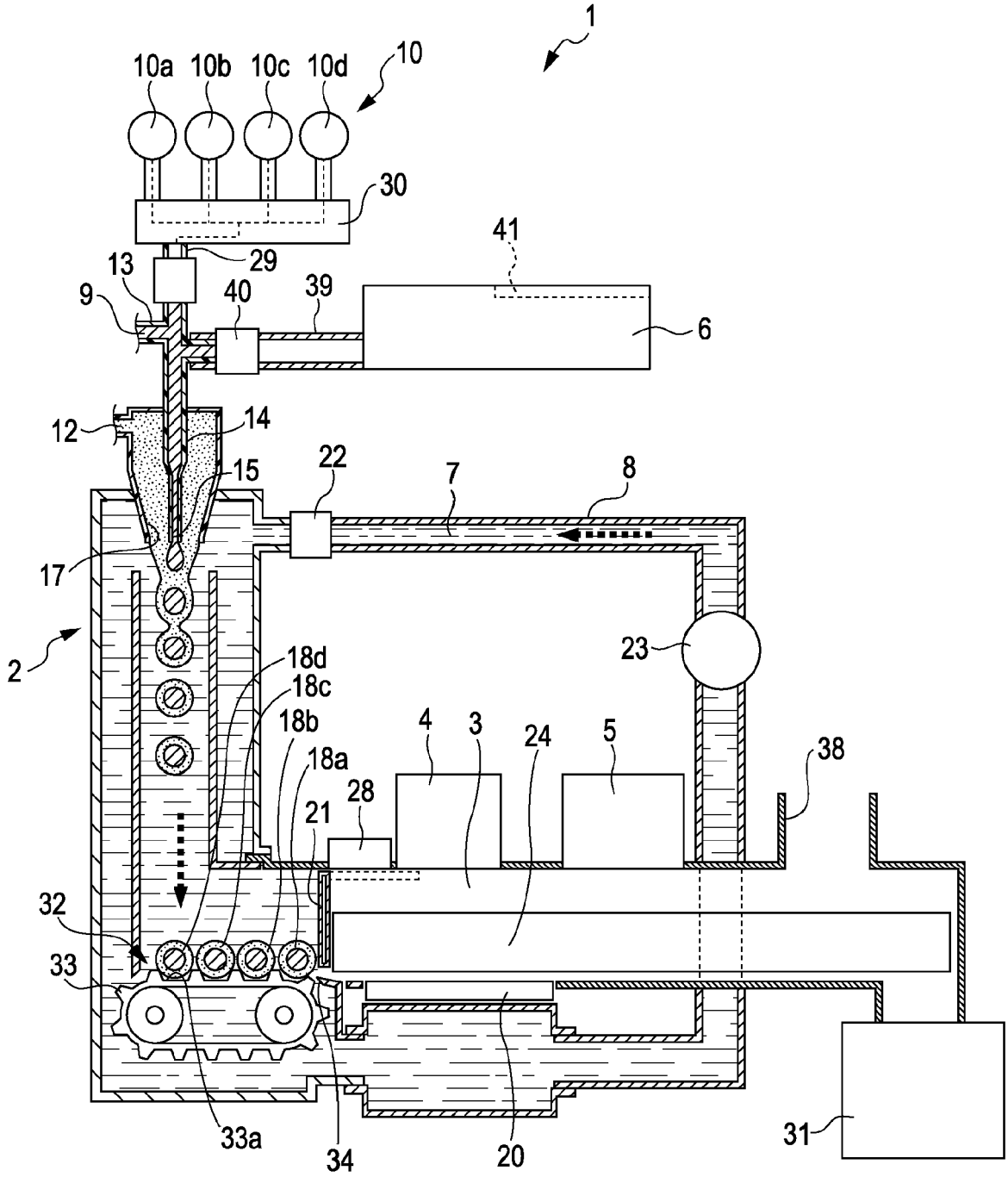
FIG. 4 is a schematic view showing a state in which four independent capsules are held according to the second embodiment.

FIG. 4 shows a state in which four independent capsules are held according to the second embodiment. After four independent capsules are formed, the control valve 22 is closed to hold the coolant 7. Since gaps are provided at the two sides of the bumpy transfer belt 33, the coolant 7 passes through the receiver 32 and flows into the cooling channel 8. After the coolant 7 passes through the receiver 32 (after a predetermined time has elapsed or after passage of the coolant is detected), the gate 21 is opened.

When the gate 21 is opened, capsules 18*a* to 18*d* leave the receiver 32, roll along a slope 34 extending to the transfer belt 24, and reach the transfer belt 24 and the driven belt 25. Then the capsules 18*a* to 18*d* are transferred to the droplet removing section 28, the amplification reaction section 3, the amplification detector 4, and the melting detection section 5 by the two belts as in the first embodiment.

Third Embodiment

Figure 5:
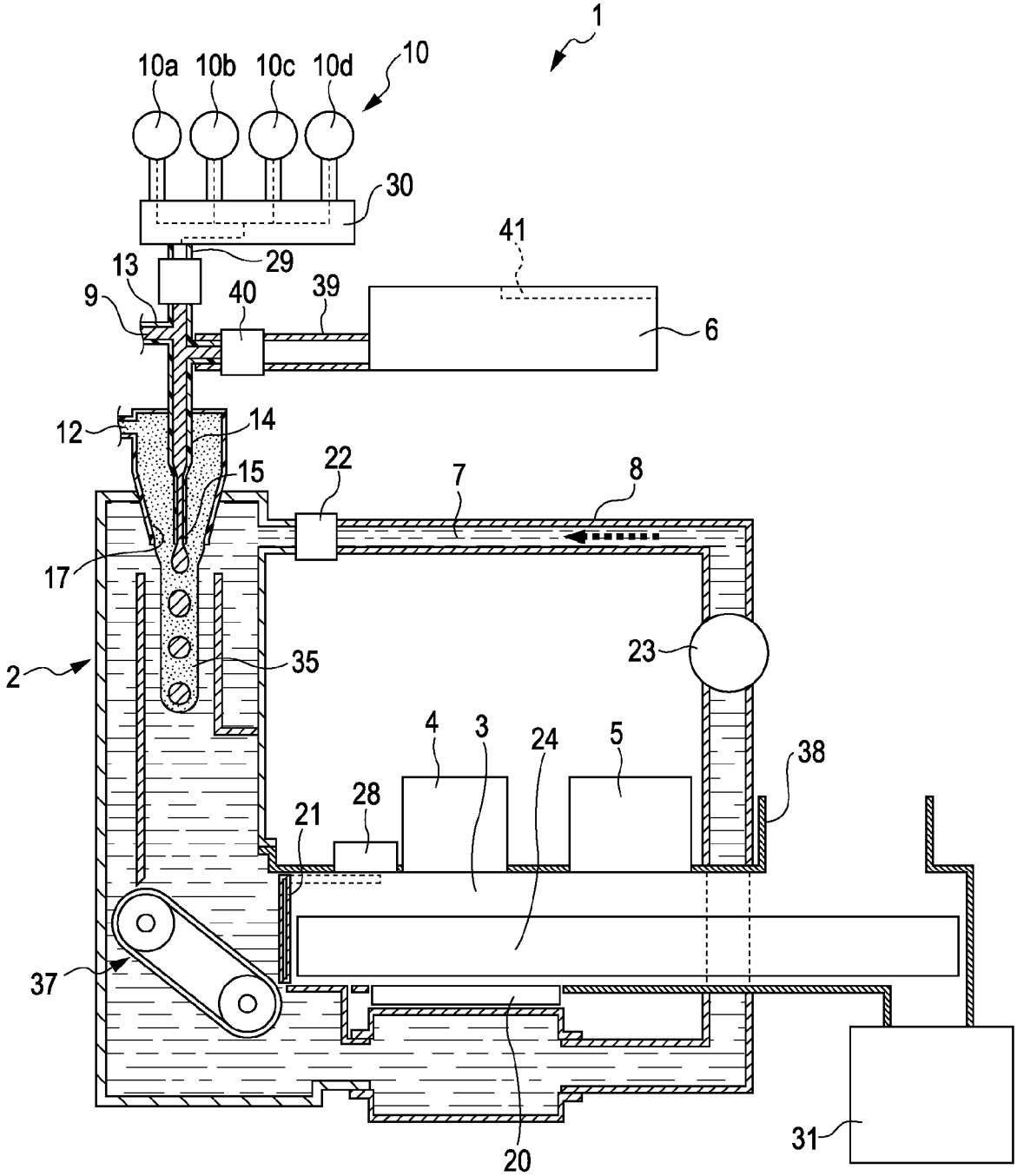
FIG. 5 is a conceptual diagram of a third embodiment of the present invention.
Figure 6:
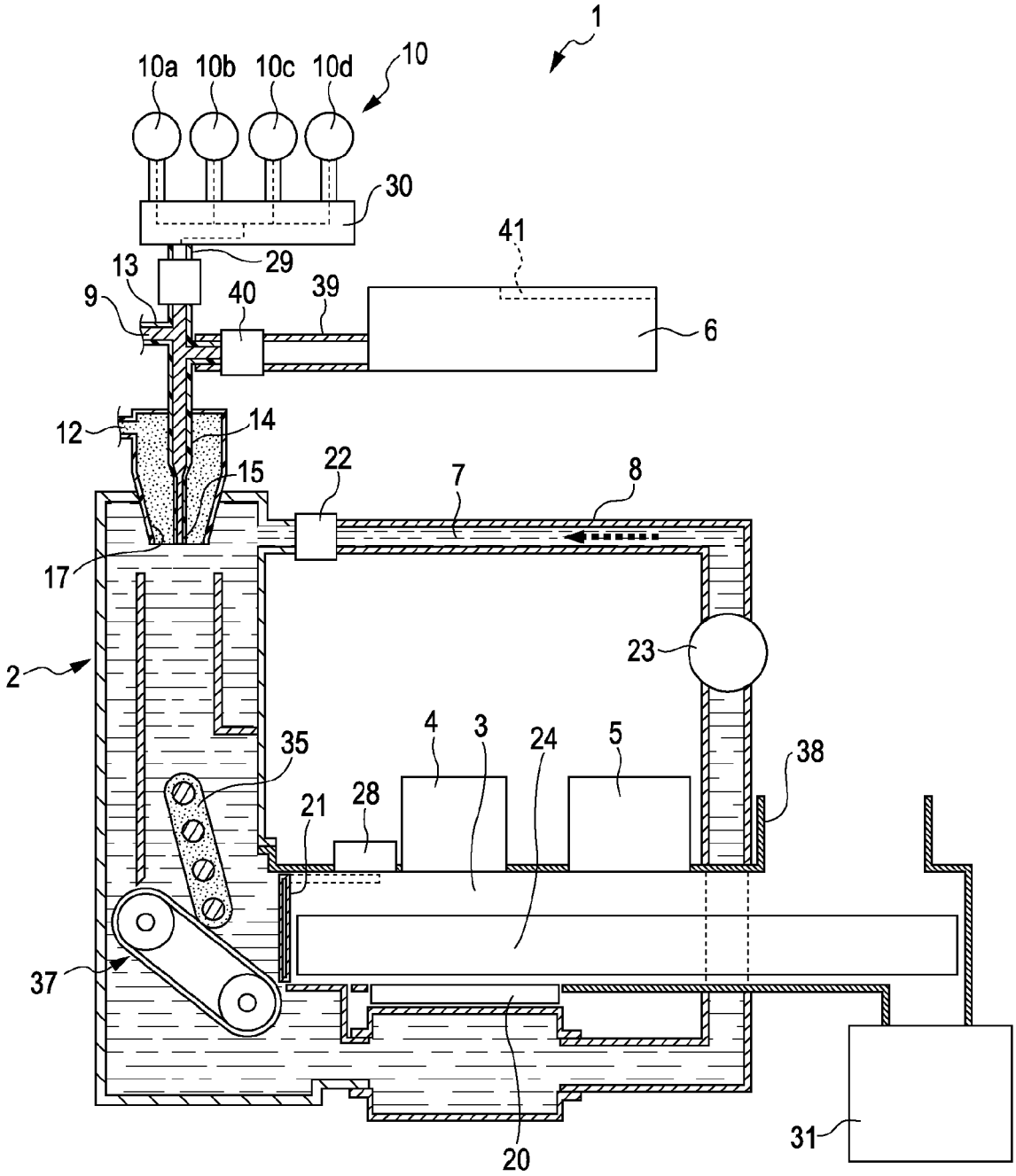
FIG. 6 is another conceptual diagram of the third embodiment.

In the biopolymer examination apparatus of the present invention, if a capsule block in which a desired number of capsules are connected is required instead of independent spherical capsules, capsules should be dropped without applying intermittent vibrations to the second nozzle 17. A third embodiment of the present invention is an embodiment in which such a capsule block is formed. FIGS. 5 and 6 are conceptual diagrams of the third embodiment. The biopolymer examination apparatus of the third embodiment differs from that of the second embodiment only in the receiver. A receiver 37 of the third embodiment is installed to incline toward the gate 21. In such a case, as shown in FIGS. 5 and 6, a capsule block including a desired number of capsules can be formed by applying vibrations after the last capsule of the capsule block is discharged.

As in the second embodiment, the third embodiment differs from the first embodiment in the step of forming capsules by sealing a target biopolymer and a reagent in each capsule and the step of transferring the capsules. Other steps of the third embodiment are the same as in the first embodiment. Once a capsule block 35 reaches the receiver 37, the coolant 7 is removed and the gate 21 is opened. The capsule block 35 reaches the transfer belt 24 and the driven belt 25 by its own weight. Then the capsule block 35 is transferred to the droplet removing section 28, the amplification reaction section 3, the amplification detector 4, and the melting detection section 5 one after next by using the two belts as in the first embodiment.

Fourth Embodiment

In the case where the biopolymer needs to be re-reacted with a new reagent after completion of formation of the capsule and the reaction, it is possible to break the capsule and encapsulate the biopolymer with the new reagent. A fourth embodiment of the present invention is directed to such a case. For example, in the case where nucleic acids obtained by PCR need to be purified, a reagent for purification is not to be enclosed in the capsule until the PCR is finished to avoid the high temperature environment during the PCR. Upon completion of the PCR, the reagent for purification is added to again form a capsule.

As shown in FIG. 1, a capsule storage 6 is provided. A capsule outlet 38 is disposed downstream of the amplification reaction section 3 and the melting detection section 5. The capsule outlet 38 may be provided with a gate. However, since the biopolymer and the like are encapsulated, there is no risk of evaporation and scattering of the solution. Thus, the gate is not always necessary and the capsule outlet 38 may remain open. The capsule 18 transferred to a position directly below the capsule outlet 38 by the transfer belt 24 and the driven belt 25 is held by a holder (not shown) and carried to the capsule storage 6.

The capsule storage 6 has a door 41. The door 41 is opened and the capsule 18 is placed in the capsule storage 6. The capsule storage 6 is joined to the specimen channel 13 via a channel 39 and a valve 40. The capsule storage 6 has a compression unit inside so that the capsules can be crushed and the contents are released to the channel. The inner wall of the capsule storage 6 is negatively charged as with the specimen channel 13 to prevent target DNA from adhering onto the inner wall.

The contents released flow into the specimen channel 13 via the channel 39 once the valve 40 is opened. At this time, a reagent to be added is supplied from the reagent channel 29 and the film solution is supplied from the second nozzle 17 simultaneously to form the capsule 18. Since the contents remain encapsulated as they are transferred to the amplification reaction section 3, the amplification detector 4, the melting detection section 5, and the discarding section 31 after the capsule 18 is formed, there is no fear of scattering of the nucleic acid to the outside.

As described below, the broken pieces of the film of the capsule 18 may be washed away by supplying water to the capsule breaking section toward the specimen channel 13 so that the broken pieces can be encapsulated and discarded. During this process, since the capsule storage 6 is isolated from the outside environment, DNA is prevented from scattering to the outside.

Fifth Embodiment

Figure 7:
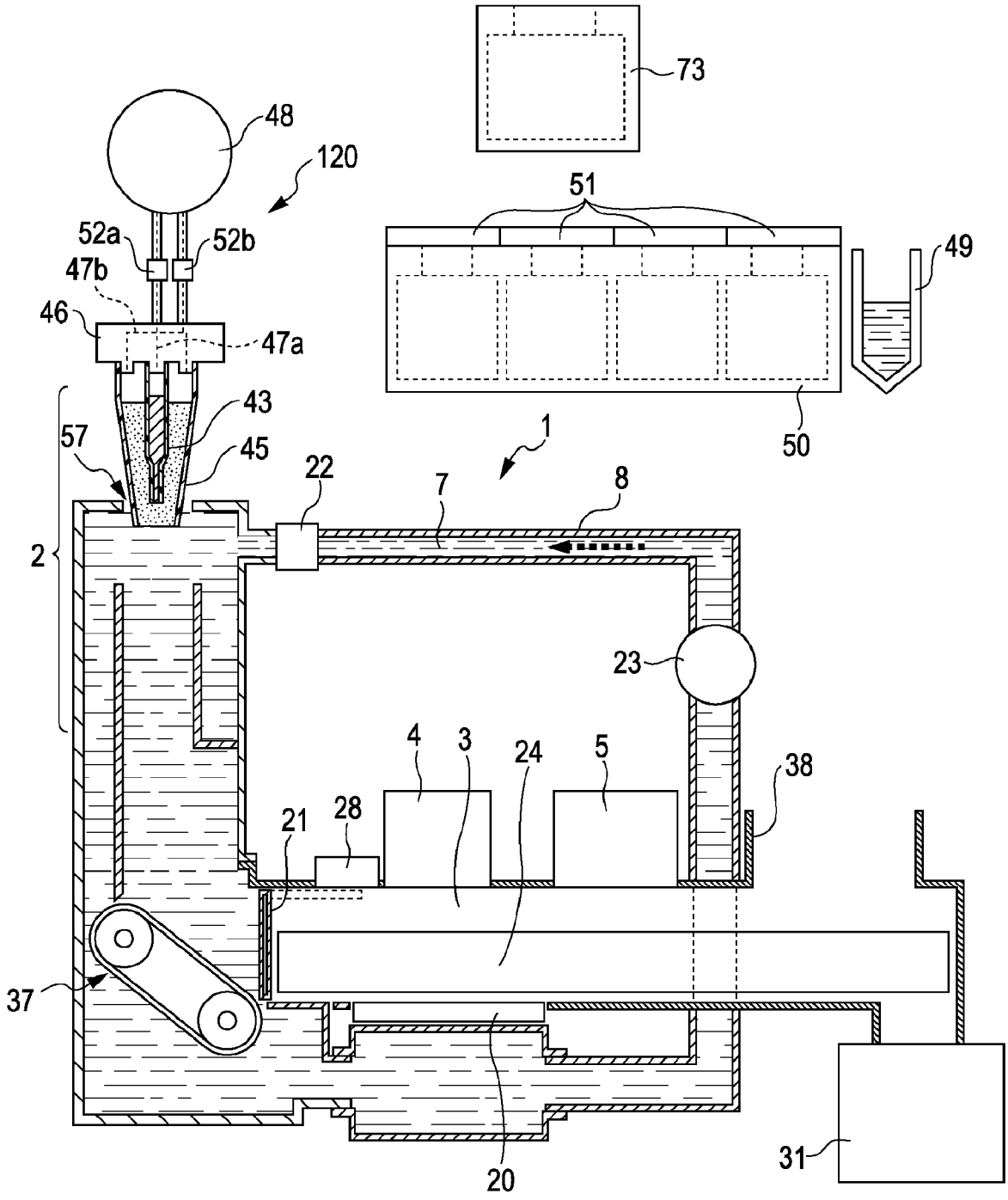
FIG. 7 is a conceptual diagram of a fifth embodiment of the present invention.

A fifth embodiment of the present invention is directed to preventing mixing of a plurality of different types of biopolymer specimens. FIG. 7 is a schematic view showing the fifth embodiment. As shown in FIG. 7, the fifth embodiment of the present invention uses the same apparatus as in the first embodiment except that the capsule-forming nozzle section 115 of the first embodiment is replaced with a detachably attached pipette tip 120. As a result, the portion that contacts the specimen 9 becomes replaceable.

In the fifth embodiment, the pipette tip 120 replaces the capsule-forming nozzle section 115 of the first embodiment and is attached to a pipette tip attaching section 57 (equivalent to the nozzle connecting port 116 of the first embodiment) of the capsule-forming section 2 to form the capsule-forming unit.

The pipette tip 120 at least includes a tip 43 and a tip 45 and is detachably attached to the capsule-forming section 2. The tip 43 and the tip 45 are attached to a tip holder 46 by being squeezed in. The tip holder 46 has aspiration paths 47*a* and 47*b* for sucking the air in and is connected to a pump 48 via valves 52*a* and 52*b*. The tip 43 is for the valve 52*a* and the tip 45 is for the valve 52*b*. The aspiration and discharge from the tips 43 and 45 are independently controlled. The tip 43 holds a specimen and a reagent and the tip 45 holds a material that can form films of capsules, such as gelatin or agar. The materials for the tip 43 and the tip 45 may be materials that do not affect the contents held in the tips. In the fifth embodiment, the tip 43 and the tip 45 contact the specimen 9 and thus can be composed of disposable materials such as plastics so that they are replaceable. The part that contacts the reagent can also be replaceable.

FIG. 7 illustrates a DNA solution retainer 49 for retaining a DNA solution and a reagent storage 50 for retaining a plurality of reagents. The DNA solution retainer 49 is an open container. A lid that opens and closes the DNA solution retainer 49 may also be provided. As with the tip 43, the material therefor can be a disposable material. The DNA solution used here is a solution containing DNA, which is a biopolymer, extracted from blood or urine by an extraction unit (not shown).

Four types of reagents are stored in the reagent storage 50. The reagent storage 50 has four doors 51 corresponding to the four reagents. The doors 51 can be opened and closed independently. In order to achieve long-term storage of the reagents, the doors 51 are usually closed. In FIG. 7, the DNA solution retainer 49 and the reagent storage 50 are illustrated at the upper right portion of the drawing for convenience sake. However, they may be positioned at any desired positions. The scale of drawing for the DNA solution retainer 49 and the reagent storage 50 is different from that for the biopolymer examining apparatus 1.

Figure 8A:
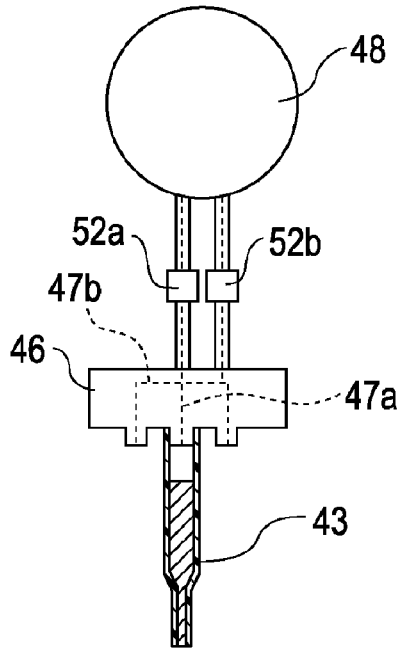
FIGS. 8A and 8B are conceptual diagrams of the fifth embodiment.

The fifth embodiment will now be described with reference to FIGS. 7, 8A, and 8B. FIG. 8A illustrates the state in which the reagent and the DNA solution are aspirated. As shown in FIG. 8A, the tip 43 is first attached to the tip holder 46 and moved to a position facing the door 51 of the reagent storage 50 shown in FIG. 7 by a driving unit (not shown). An end portion of the tip 43 is then inserted into the reagent storage 50. Only the valve 52*a* is opened and the pump 48 is driven to aspirate the reagent into the tip 43 via the aspiration path 47*a*. After the tip 43 is moved to the position facing the DNA solution retainer 49 in FIG. 7, the end of the tip 43 is inserted into the DNA solution retainer 49. Only the valve 52*a* is opened, and the pump 48 is driven to aspirate the DNA solution, which is the specimen inside DNA solution retainer 49, via the aspiration path 47*a*. After aspiration, the tip is moved away from the DNA solution retainer 49.

In this embodiment, the reagent is aspirated into the tip 43 first and then the DNA solution. Alternatively, the reagent may be supplied from a rear end of the tip 43 by applying pressure. In such a case, a reagent supplying path branching from the aspiration path 47*a* is provided to the reagent storage 50.

Figure 8B:
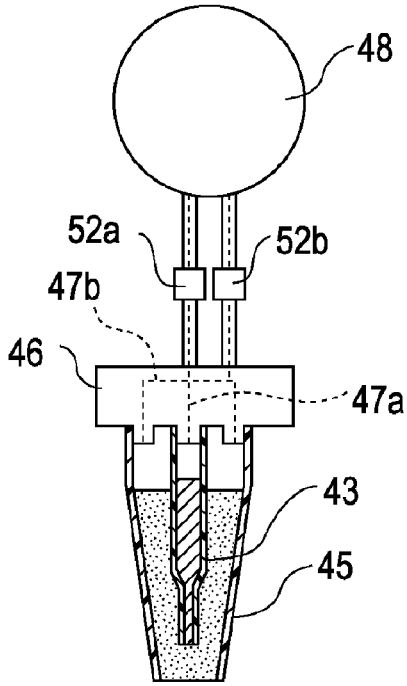

Next, as shown in FIG. 8B, a new tip 45 is attached to the tip holder 46 so that the tip 45 surrounds the tip 43. The tip 45 is moved to a capsule film solution storage 73 and inserted into the capsule film solution storage 73 shown in FIG. 7. Only the valve 52*b* is opened, and the pump 48 is driven to aspirate the capsule film solution into the tip 45 via the aspiration path 47*b*. FIG. 8B shows the state in which the capsule film solution is aspirated. As with the reagent, the capsule film solution may be supplied from the rear end of the tip 45 by applying pressure instead of aspiration.

After the reagent, the DNA solution, and the film solution are retained in the pipette tip, the tip 43 and the tip 45 are attached to the pipette tip attaching section 57 of the capsule-forming section 2, and the three liquids are discharged into the coolant 7. As in the first embodiment, a capsule containing the reagent and the specimen 9 at the center moves downward in the coolant 7 in the capsule channel 100. Then the capsule is transferred to the amplification reaction section 3, the amplification detector 4, the melting detection section 5, and then to the discarding section 31 as in the first embodiment.

Sixth Embodiment

Unlike in the fifth embodiment in which one reagent is handled in one operation, in a sixth embodiment of the present invention, a plurality of reagents are handled in one operation. FIG. 9 is a conceptual diagram showing the sixth embodiment in which a plurality of reagents are handled. In the sixth embodiment, three tips can be provided. According to this structure, a DNA solution tip 71 is attached at the outer side or the inner side of a reagent retaining tip 70. In this embodiment, the DNA solution tip 71 is attached to the outer side.

Figure 9C:
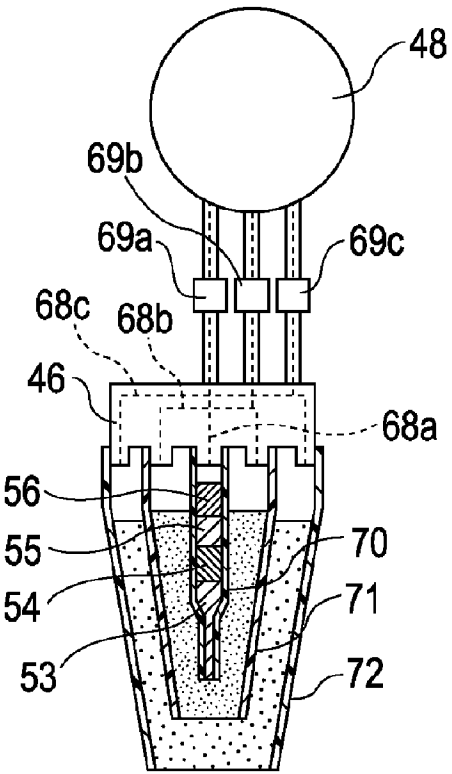
FIGS. 9A to 9C are conceptual diagrams of a sixth embodiment of the present invention in which a plurality of reagents are handled.
Figure 9B:
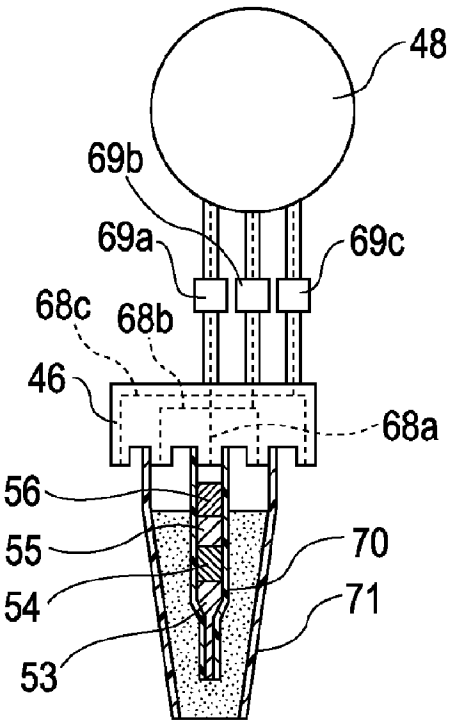
Figure 9A:
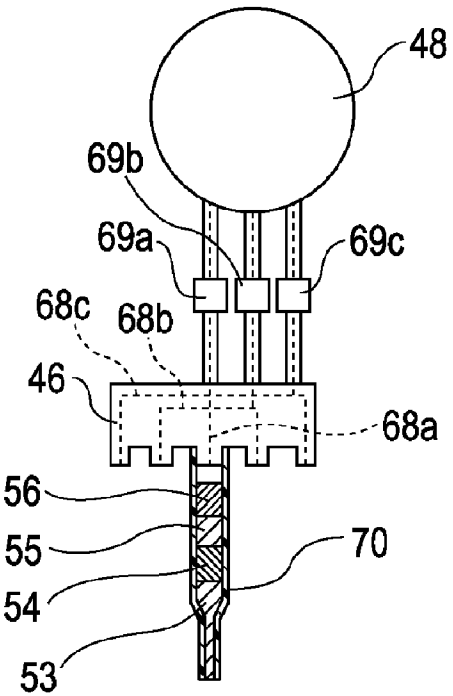

As in the fifth embodiment, the reagent retaining tip 70 of the sixth embodiment is first attached as shown in FIG. 9A. Then the reagent to be aspirated is brought into contact with an end of the reagent retaining tip 70. Only a valve 69*a* is opened, and the pump 48 is driven to render the pressure inside the reagent retaining tip 70 negative via an aspiration path 68*a* so that the reagent is aspirated. FIG. 9A shows the state after four reagents are aspirated. The first, second, third, and fourth reagents 53, 54, 55, and 56 are arranged in that order from the bottom. As shown in FIG. 9B, only a valve 69*b* to which the DNA solution tip 71 is attached is opened and the pump 48 is driven to aspirate the reagent into the DNA solution tip 71 via an aspiration path 68*b*. As shown in FIG. 9C, only a valve 69*c* to which the DNA solution tip 72 is attached is opened and the pump 48 is driven to aspirate the reagent into the DNA solution tip 72 via an aspiration path 68*c*.

The tip retaining the reagent, the DNA solution, and the capsule film solution is attached to the pipette tip attaching section 57 of the capsule-forming section 2 and the three liquids are discharged in the coolant 7, as in the fifth embodiment. As in the first embodiment, a capsule containing the reagent and the specimen solution at the center moves downward in the coolant in the capsule channel 100. Then the capsule is transferred to the amplification reaction section 3, the amplification detector 4, the melting detection section 5, and then to the discarding section 31 as in the first embodiment.

In making capsules containing different reagents, the first, second, third, and fourth reagents 53, 54, 55, and 56 are discharged one after next. As a result, capsules containing a specimen and respective reagents are formed. If the intermittent vibrations are applied to the tips 70, 71, and 72 during formation of the capsules, independent capsules are formed. If no intermittent vibrations are applied, a capsule block including a plurality of connected capsules is formed.

In order to prevent DNA not contained in the specimen from entering the capsules, an unused pipette tip can be used for every specimen. In the fifth and sixth embodiments, at least the tips that have come into contact with the DNA solution can be detached from the tip holder 46 upon completion of examination of one specimen. Thus, unused tips are attached before examining the next specimen. The detachment and attachment of the tips are the same as for dispensers. The tips are attached by being squeezed in and detached by using an eject mechanism that pushes out the tips.

In this embodiment, a dropping technique that uses multiple nozzles is applied to the capsule formation. Alternatively, a rotary technique using gelatin film sheets can also be applied. In particular, the capsule-forming section and the coolant channel may be replaced with those of a rotary type that use two rotating dies, for example.

Seventh Embodiment

In the first embodiment, the inner wall of the capsule-forming nozzle section 115 is negatively charged to be repulsive to DNA, i.e., the biopolymer, to prevent contamination. In contrast, in the fifth and sixth embodiments, the pipette tip is replaced every time examination of one specimen is finished so that the parts that have come into contact with the specimen 9 are replaceable.

In this regard, an embodiment further including a washing unit for washing the channel of the capsule-forming nozzle section 115, which is the part that contacts the specimen, of the first embodiment is described as a seventh embodiment of the present invention. After the first specimen has finished flowing in the specimen introducing section, the channel is washed before the next specimen is injected. In other words, the capsule-forming nozzle section 115 is washed between injection of one specimen and the next to prevent contamination of specimens. As with the specimen and reagents, the solution used for washing is ultimately enclosed in capsules and discarded.

Thus, DNA contained in the solution after washing neither remains in the apparatus nor is released to atmosphere. Examples of the solution used for washing the channel include DNA-OFF (product of Takara Bio Inc.) which is a commercially available DNA remover, and deoxyribonuclease. Other substances that can remove DNA from the channel can also be selected. Pure water may be injected after such a solution by way of caution. In such a case, pure water should be encapsulated and discarded to prevent DNA from remaining in the apparatus or being released in the atmosphere. The solution may be mixed with a fluorescence agent and the fluorescence may be detected with the detecting unit of the present invention to mark the breakpoint of the biopolymer examination.

In view of the above, when the biopolymer examining apparatus that includes a capsule-forming unit configured to form a capsule by sealing a target biopolymer and a reagent with a capsule film, a transferring unit configured to transfer the capsule, an amplification reaction unit configured to amplify the target biopolymer while having the target biopolymer enclosed in the capsule, and a detecting unit configured to detect the amplified target biopolymer while having the target biopolymer enclosed in the capsule is provided with the unit configured to wash the part that contacts the specimen as described above, the apparatus in which the target biopolymer is prevented from being contaminated can be provided.

Eighth Embodiment

An eighth embodiment of the present invention provides a biopolymer examining apparatus including a detachably attached cartridge that can be replaced after a particular length of time, e.g., after the amplification and detection are finished. This is to satisfy the demand of storing a plurality of types of biopolymers on a sample-by-sample basis.

Figure 10:
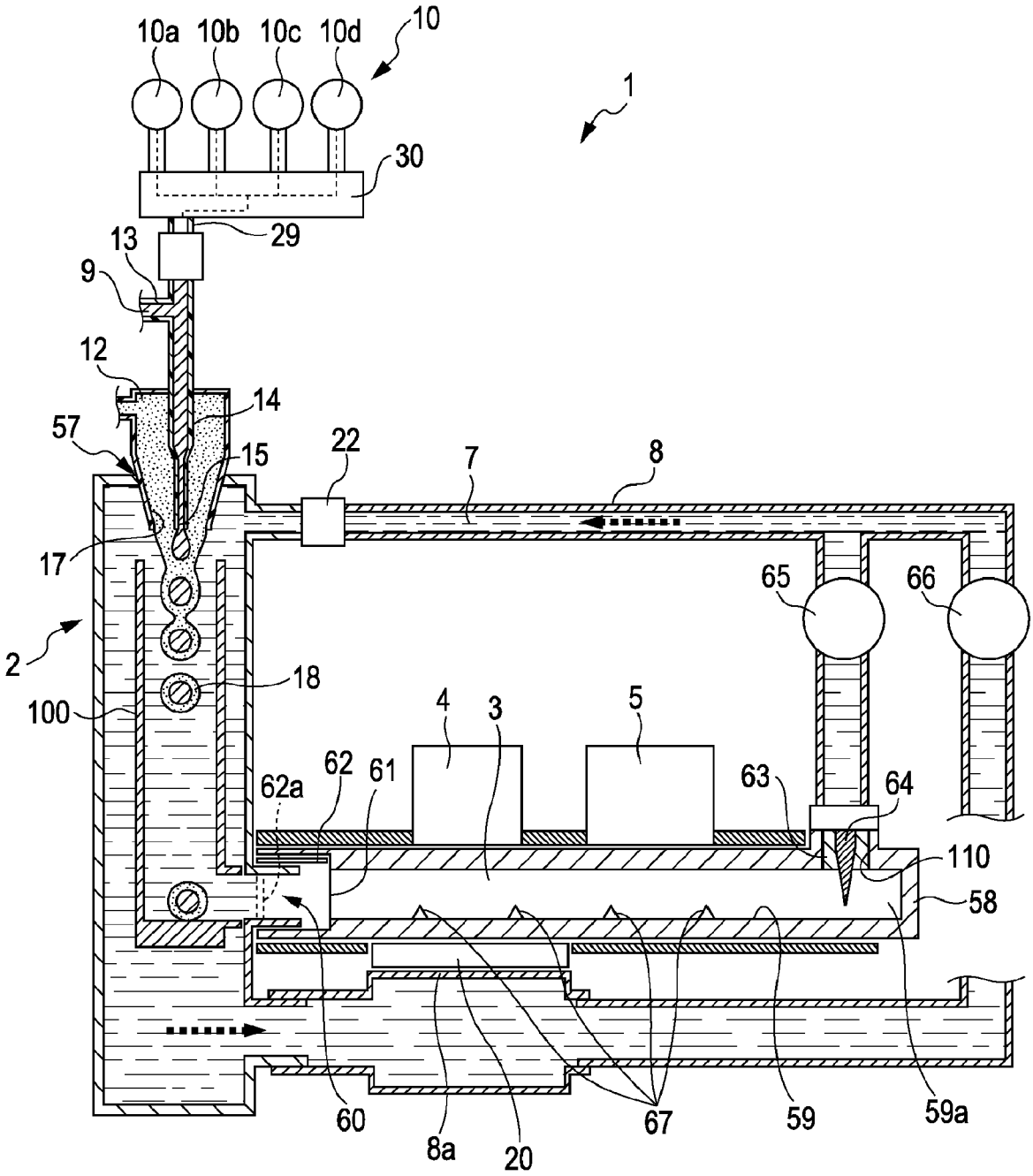
FIG. 10 is a cross-sectional view of a relevant part of a biopolymer examining apparatus with a cartridge.
Figure 11:
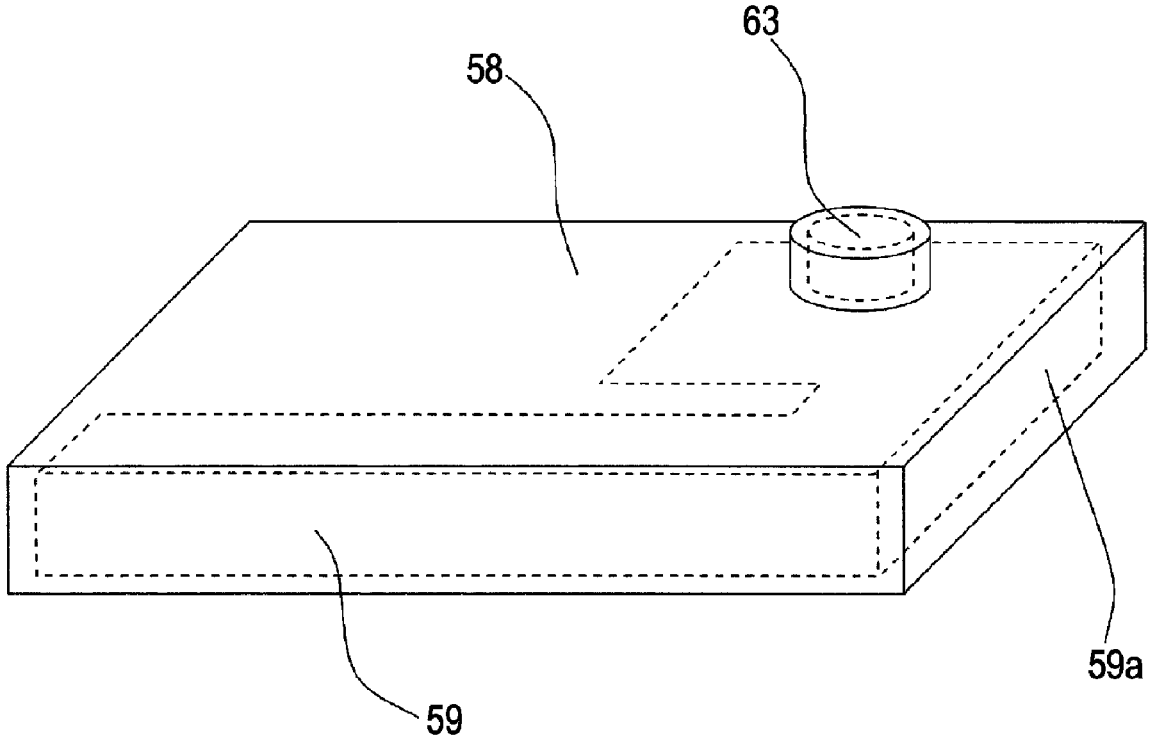
FIG. 11 is a schematic view of a cartridge of the present invention.

An example of such a biopolymer examining apparatus is one having a cartridge 58 shown in the perspective view of FIG. 11. FIG. 10 is a cross-sectional view of a relevant part of the biopolymer examining apparatus with the cartridge 58. The biopolymer examining apparatus with the cartridge, which is the eighth embodiment of the present invention, is described below.

First, unlike the first embodiment of the present invention, in the capsule-forming unit, the capsule channel 100 does not have the receiver 19, the gate 21, or the transferring unit connecting port 101 but has a connecting section 60 as shown in FIG. 10. Unlike the cooling channel 8 of the first embodiment of the present invention, a pump 65 and a pump 66 that circulate the coolant 7 are provided. Other structures, such as the capsule-forming nozzle section 115 for forming biopolymer-containing capsules, are the same as in the first embodiment.

In the eighth embodiment of the present invention, the cartridge 58 is constituted by a capsule introducing part 61 fitted into the connecting section 60, a transfer channel 59 for transferring capsules, a discarding section 59*a*, and an opening 110 formed in the upper part of the cartridge 58. The capsule introducing part 61 has a cover 62 that can be opened and closed. When the cartridge 58 is attached to the connecting section 60 of the capsule channel 100, the cover 62 opens as shown in FIG. 10 by being pushed by the connecting section 60, thereby connecting the capsule channel 100 to the transfer channel 59. When the cartridge 58 is detached from the apparatus, the cover 62 is at the position indicated by a dotted line 62*a* and keeps the transfer channel 59 closed.

The internal diameter of the transfer channel 59 indicated by a dotted line in FIG. 11 is slightly larger than the outer diameter of one capsule 18. The capsules 18 pass through the transfer channel 59 one at a time. As indicated by the dotted lines in FIG. 11, the discarding section 59*a* that can store at least one capsule 18 is disposed at the right end of the transfer channel 59. These components can be integrated as one cartridge. The opening 110 is formed above the discarding section 59*a*, and a sealing member 63, i.e., an elastic member, is disposed at the opening 110.

The sealing member 63 can be a member that can be penetrated with a needle. The needle can have a hollow structure so that the needle can form part of the channel in the apparatus. In such a case, a lifting mechanism that moves the cartridge 58 up and down (not shown) may be provided so that a needle 64 with a hole at its tip shown in FIG. 10 penetrates the cartridge 58. When the cartridge 58 is attached to the apparatus, the amplification reaction section 3, the amplification detector 4, and the melting detection section 5 are situated above the cartridge 58 as in the first embodiment. The cartridge 58 is fixed between the capsule channel 100 and the cooling channel 8 as the needle 64 penetrates the sealing member 63.

In the eighth embodiment, in order to amplify and detect the biopolymer contained in the capsule 18, the capsule 18 needs to be temporarily fixed at a particular position in the transfer channel 59 in the cartridge 58, the position corresponding to the amplification reaction unit and the detecting unit. To do this, projections 67 can be formed on the bottom of the cartridge 58 at the inner side. The projections 67 have a function of stopping the capsule 18 transferred by the transferring unit, such as a coolant or the like, at that position. The portions of the transfer channel 59 at the projections 67 can be slightly smaller than the outer diameter of the capsule 18 so that the transferred capsule 18 can stop at the position of the projection 67.

The eighth embodiment of the present invention includes the steps of forming a capsule by sealing a target biopolymer and a reagent with a capsule film, transferring the capsule, amplifying the target biopolymer, and detecting the amplified target biopolymer.

In accordance to the structure of the eighth embodiment of the present invention, steps of transferring the capsule 18 to positions corresponding to the amplification reaction unit and to the detecting unit will now be described. Formation of the capsule 18 is the same as in the first embodiment of the present invention. The capsule 18 is formed by discharging a specimen and a reagent from the first nozzle 15 and a capsule film solution from the second nozzle 17.

In the eighth embodiment of the present invention, a second circulation channel for the coolant 7 is formed by fitting the capsule introducing part 61 of the cartridge 58 into the connecting section 60 of the capsule channel 100 and allowing the needle 64 to penetrate the sealing member 63. The second circulation channel includes the capsule channel 100, the cartridge 58, the needle 64, the pump 65, and the control valve 22. The coolant 7 that passes through the connecting section 60 circulates via the transfer channel 59 in the cartridge 58, the needle 64, and the pump 65.

The first circulation channel also used in the first embodiment includes the capsule-forming section 2 and the cooling channel 8 including the pump 66. As shown in FIG. 10, the second circulation channel and the first circulation channel overlap each other.

In the eighth embodiment, the coolant supplied by the pump 66 through the control valve 22 into the second circulation channel can fill the second circulation channel. As in the first embodiment, a capsule formed by discharging a specimen and a reagent from the first nozzle 15 and the capsule film solution from the second nozzle 17 enters the second circulation channel filled with the coolant and reaches the bottom of the capsule channel 100.

The coolant 7 is used as the driving source for transferring the capsule 18 in the cartridge 58. As the coolant 7 flows, the capsule 18 is transferred to the amplification reaction section 3, the amplification detector 4, and the melting detection section 5 one after next as in the first embodiment. In the eighth embodiment, the projections 67 can stop the capsule 18 by sandwiching the capsule 18 transferred to the positions corresponding to the amplification reaction section 3, the amplification detector 4, and the melting detection section 5. When the cartridge 58 is used, the capsule 18 can be transferred to the amplification reaction section 3 and subjected to amplification and can be transferred to the detecting unit and subjected to detection without breaking the capsule 18.

In order to have the capsule 18 cross over the projections 67 and to be transferred to the amplification reaction unit and the detecting unit, the flow rate of the coolant 7 may be changed. For example, upon completion of the amplification reaction and various detections, the capsule 18 can cross over the projections 67 by elastic deformation and be transferred ahead by continuously supplying the coolant 7 at a higher flow rate. After the capsule 18 is transferred to a next projection 67, the flow or the coolant 7 is stopped to have the capsule 18 caught by the projection 67. As a result, the capsule 18 stays there.

After amplification and detection, the capsule 18 is transferred to the discarding section 59*a* and the examination is ended. After the capsule 18 is transferred to the discarding section 59*a*, the control valve 22 is closed to stop the coolant 7 in the cartridge 58 from flowing in. Then the pump 65 is operated for a particular length of time to evacuate the coolant 7 remaining in the cartridge 58 through the needle 64. The needle 64 is detached from the cartridge 58 by using a lifting mechanism (not shown in the drawing).

As a result, the cartridge 58 can be detached from the biopolymer examining apparatus 1. The cartridge 58 is pulled to the right in FIG. 10. Then the cover 62 returns to the position indicated by the dotted line 62 and closes the transfer channel 59. Since the transfer channel 59 is isolated from the outside environment, the analyzed capsules stored in the discarding section 59*a* do not easily go out of the discarding section 59*a*. Thus, contamination of other target biopolymer is suppressed.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-201329 filed Aug. 4, 2008, which is hereby incorporated by reference herein in its entirety.

What is claimed is:

1. A nucleic acid examining apparatus comprising:

a capsule-forming unit configured to form a capsule by sealing a target nucleic acid and a reagent with a capsule film;

a transferring unit comprising a transfer belt configured to transfer the capsule;

an amplification reaction unit configured to amplify the target nucleic acid while having the target nucleic acid enclosed in the capsule; and a detecting unit configured to detect the amplified target nucleic acid while having the target nucleic acid enclosed in the capsule, wherein the detecting unit comprises an amplification detector configured to detect amplification of DNA and a melting detection section configured to conduct thermal melting analysis.

2. The nucleic acid examining apparatus according to claim 1, further comprising:

a droplet removing unit configured to remove droplets adhering onto the capsule.

3. The nucleic acid examining apparatus according to claim 1, further comprising:

a discarding unit configured to discard the capsule.

4. The nucleic acid examining apparatus according to claim 1, wherein the amplification reaction unit comprises a temperature controller.

5. The nucleic acid examining apparatus according to claim 4, wherein the temperature controller is a peltier device.

6. The nucleic acid examining apparatus according to claim 1, wherein the capsule-forming unit comprises:

a capsule-forming section;

a capsule-forming nozzle section; and a cooling channel through which a coolant flows.

7. The nucleic acid examining apparatus according to claim 1, wherein the capsule-forming unit further comprises a vibrator configured to apply vibrations.

8. The nucleic acid examining apparatus according to claim 6, wherein the capsule-forming nozzle section comprises a reagent switcher that allows a choice of the reagent from a plurality of types of reagents.

9. The nucleic acid examining apparatus according to claim 6, wherein the capsule-forming nozzle section further comprises a common channel into which a reagent channel and a specimen channel through which a specimen is supplied are merged.

10. The nucleic acid examining apparatus according to claim 9, wherein an inner surface of the common channel is treated to prevent adhesion of the specimen.

11. The nucleic acid examining apparatus according to claim 6, wherein the capsule-forming nozzle section has a part that contacts a specimen and that is replaceable.

12. The nucleic acid examining apparatus according to claim 6, further comprising a washing unit at the capsule-forming nozzle section, the washing unit being configured to wash a part of the capsule-forming nozzle section that contacts a specimen.

13. A method for examining a nucleic acid, comprising the steps of:

forming a capsule by sealing a target nucleic acid and a reagent with a capsule film;

transferring the capsule by using a transfer belt;

amplifying the target nucleic acid while having the target nucleic acid enclosed in the capsule; and detecting the amplified target nucleic acid while having the target nucleic acid enclosed in the capsule, wherein the detecting step is amplification detection for detecting amplification of DNA and melting detection for conducting thermal melting analysis of DNA.

14. The method according to claim 13, further comprising a step of:

discarding the capsule after the detecting step.

15. The method according to claim 13, wherein, in the transferring step, the capsule is automatically transferred to an amplification reaction unit and a detecting unit.

16. The method according to claim 13, wherein the forming step is a step of forming at least one independent capsule, a plurality of desired independent capsules, or a capsule block containing a plurality of desired connected capsules.

17. The method according to claim 13, wherein the forming step, the transferring step, the amplifying step, and the detecting step are sequentially performed within a channel disposed in an apparatus.

18. The method according to claim 13, further comprising a step of:

forming a second capsule containing a target nucleic acid and a reagent at least one of which is changed from those of the capsule formed by the other forming step, the step of forming the second capsule being performed after the other forming step.

19. The nucleic acid examining apparatus according to claim 1, wherein the capsule-forming unit is configured to form a capsule by sealing a target nucleic acid and a reagent and a magnetic particle with a capsule film, and wherein the transferring unit comprises a magnet.

20. The method for examining a nucleic acid according to claim 13, comprising the steps of:

forming a capsule by sealing a target nucleic acid and a reagent and a magnetic particle with a capsule film; and transferring the capsule by a magnetic force.

21. The nucleic acid examining apparatus according to claim 1, further comprising:

a droplet removing unit configured to remove droplets adhering onto the capsule.

22. A nucleic acid examining apparatus comprising:

a capsule-forming unit configured to form a capsule by sealing a target nucleic acid and a reagent with a capsule film;

a transferring unit configured to transfer the capsule;

an amplification reaction unit configured to amplify the target nucleic acid while having the target nucleic acid enclosed in the capsule; and a detecting unit configured to detect the amplified target nucleic acid while having the target nucleic acid enclosed in the capsule, wherein the detecting unit comprises an amplification detector configured to detect amplification of DNA and a melting detection section configured to conduct thermal melting analysis, and wherein the transferring unit is configured as a cartridge that can be attached to and detached from the nucleic acid examining apparatus.

23. A method for examining a nucleic acid, comprising the steps of:

forming a capsule by sealing a target nucleic acid and a reagent with a capsule film;

transferring the capsule;

amplifying the target nucleic acid while having the target nucleic acid enclosed in the capsule; and detecting the amplified target nucleic acid while having the target nucleic acid enclosed in the capsule, wherein the detecting step is amplification detection for detecting amplification of DNA and melting detection for conducting thermal melting analysis of DNA, wherein the transferring step transfers the capsule by using a cartridge that can be attached to and detached from a nucleic acid examining apparatus.

* * * * *